US005535471A

United States Patent [19]

Guldi

[11] Patent Number: 5,535,471

[45] Date of Patent: Jul. 16, 1996

[54] TOOL FOR CLEANING LPCVD FURNACE TUBE

[75] Inventor: Richard L. Guldi, Dallas, Tex.

[73] Assignee: Texas Instruments Incorporated, Dallas, Tex.

[21] Appl. No.: 168,826

[22] Filed: Dec. 15, 1993

[51] Int. Cl.[6] ..... A47L 9/06

[52] U.S. Cl. ..... 15/395; 15/401

[58] Field of Search ..... 15/395, 401, 402, 15/304

[56] References Cited

U.S. PATENT DOCUMENTS

| | | | |
|---|---|---|---|
| 1,869,730 | 8/1932 | Antle | 15/395 X |
| 1,994,616 | 3/1935 | Leitzell | 15/395 X |
| 2,193,999 | 3/1940 | Allen | 15/304 X |
| 2,606,338 | 8/1952 | De Lorenzo | 15/395 |
| 4,715,838 | 12/1987 | Kulander | 15/304 X |
| 4,976,002 | 12/1990 | Leonov et al. | 15/395 X |

FOREIGN PATENT DOCUMENTS

| | | | |
|---|---|---|---|
| 24548 | 2/1932 | Netherlands | 15/395 |

*Primary Examiner*—Christopher K. Moore
*Attorney, Agent, or Firm*—Paul C. Hashim; Wade James Brady; Richard L. Donaldson

[57] ABSTRACT

A tool for cleaning the interior of a tube, such as a neck portion of a processing tube of an lpcvd apparatus, or the like, has a pipe that may have at least one hole, and preferably a plurality of holes, spaced from an insulating handle along the length of the pipe in a direction toward a distal end of the pipe to allow cooling atmosphere to be drawn into the pipe. A scraper plate having a shape substantially conforming to an interior shape of the tube and a beveled peripheral edge is attached at the distal end of the pipe. A baffle plate of size smaller than the scraper plate is affixed to the scraper plate by a plurality of standoffs between the scraper plate on an exterior side opposite the interior side and the baffle plate, wherein the baffle plate forms a debris collection region between a peripheral side of the baffle plate and the tube at the exterior side of the scraper plate when the tool is inserted into the tube. A vacuum line connector may be attached to a proximate end of the tube, and, optionally, a plurality of cooling holes may be provided in the vacuum line connector to admit a cooling atmosphere into the vacuum line when it is connected to the vacuum line connector. Although the tool can be made of various suitable materials, the pipe, the scrapper and baffle plates, and the plurality of standoffs may be of stainless steel, or of a synthetic resin polymer, such as "Teflon".

17 Claims, 1 Drawing Sheet

TOOL FOR CLEANING LPCVD FURNACE TUBE

BACKGROUND OF THE INVENTION

1. Field of the Invention

This invention relates to improvements in cleaning tools, and more particularly to improvements in tools for particular application in cleaning lpcvd furnace tubes, or the like.

2. Relevant Background

In the production of semiconductor products, low pressure chemical vapor deposition (lpcvd) apparatuses are used. Such lpcvd apparatuses typically have a processing tube, generally made of quartz, or similar material, that has a portion extending from the apparatus for connection to a vacuum line for evacuating the processing chamber. The processing tube has a relatively long portion, for instance, of about eight to twelve feet in length, having a diameter, for example of about eight to ten inches, within which the semiconductor wafers to be processed are located on a cantilevered beam.

The neck portion of the beam that extends from the processing chamber for connection to the vacuum line is of smaller diameter, for example, of about two to four inches. The neck portion may have a clamp receiving ridge or the like to removably secure a flange that attaches to a vacuum line to evacuate the interior of the tube and processing chamber into which it extends. The transition region between the larger and smaller diameter regions of the tube is usually smoothly curved, and the entire tube generally has a circular cross-sectional shape along its length to facilitate uniform gaseous flow therealong.

A major source of particles during the operation of such apparatuses, especially in processes involving silicon oxide or silicon oxynitride deposited using a tetra-ethyl-ortho-silicate (TEOS) source, or involving silicon nitride, is by-product deposits that build up inside the neck portion of the tube where it protrudes out of the furnace and attaches to the auxiliary plumbing connections. The by-products tend to deposit in this region because of the lower temperatures that exist in the regions of tube as it exits the processing apparatus. These deposits need to be periodically removed before they flake off and contaminate the actual deposition region inside the tube.

In the past, the removal of such deposits was done by disconnecting the auxiliary tube plumbing, then alternately scraping inside the neck and applying a vacuum to the outer end of the neck portion of the tube. The thoroughness of this procedure is highly operator dependent, and requires a great degree of care to perform. If not performed carefully and thoroughly, the process can, and often does, lead to higher particles inside the deposition zone near the tube neck due to recontamination inside the tube.

SUMMARY

In light of the above, it is, therefore, an object of the invention to provide an improved cleaning tool.

It is another object of the invention to provide a tool for cleaning inside an lpcvd furnace tube, or the like.

It is another object of the invention to provide a tool of the type described that enables a vacuum to be applied concurrently with scraping operations in cleaning an lpcvd furnace tube, or the like.

It is yet another object of the invention to provide a tool of the type described that assists in enabling efficient particle removal from an lpcvd furnace tube, or the like, without recontaminating the furnace tube during the cleaning step.

It is yet another object of the invention to provide a tool of the type described that allows an applied vacuum to be adjusted to prevent overheating in the downstream vacuum line.

It is still another object of the invention to provide a tool of the type described that can be insulated to protect operators from burns.

These and other objects, features and advantages of the invention will be apparent to those skilled in the art from the following detailed description of the invention, when read in conjunction with the accompanying drawings and appended claims.

According to a broad aspect of the invention, a tool for cleaning the interior of a tube, such as a neck portion of a processing tube of an lpcvd apparatus, or the like, is presented. The tool has a pipe that may have at least one hole, and preferably a plurality of holes, spaced from an insulating handle along the length of the pipe in a direction toward a distal end of the pipe to allow cooling atmosphere to be drawn into the pipe. A scraper plate having a shape substantially conforming to an interior shape of the tube and a beveled peripheral edge is attached at the distal end of the pipe. A baffle plate of size smaller than the scraper plate is affixed to the scraper plate by a plurality of standoffs between the scraper plate on an exterior side opposite the interior side and the baffle plate, wherein the baffle plate forms a debris collection region between a peripheral side of the baffle plate and the tube at the exterior side of the scraper plate when the tool is inserted into the tube.

Preferably, a vacuum line connector is attached to a proximate end of the tube, and, optionally, a plurality of cooling holes in the vacuum line connector to admit a cooling atmosphere into the vacuum line when it is connected to the vacuum line connector. Although the tool can be made of various suitable materials, the pipe, the scrapper and baffle plates, and the plurality of standoffs may be of stainless steel, or of a synthetic resin polymer.

BRIEF DESCRIPTION OF THE DRAWING

The invention is illustrated in the accompanying drawing, in which.

DETAILED DESCRIPTION OF A PREFERRED EMBODIMENT

Figure 1:
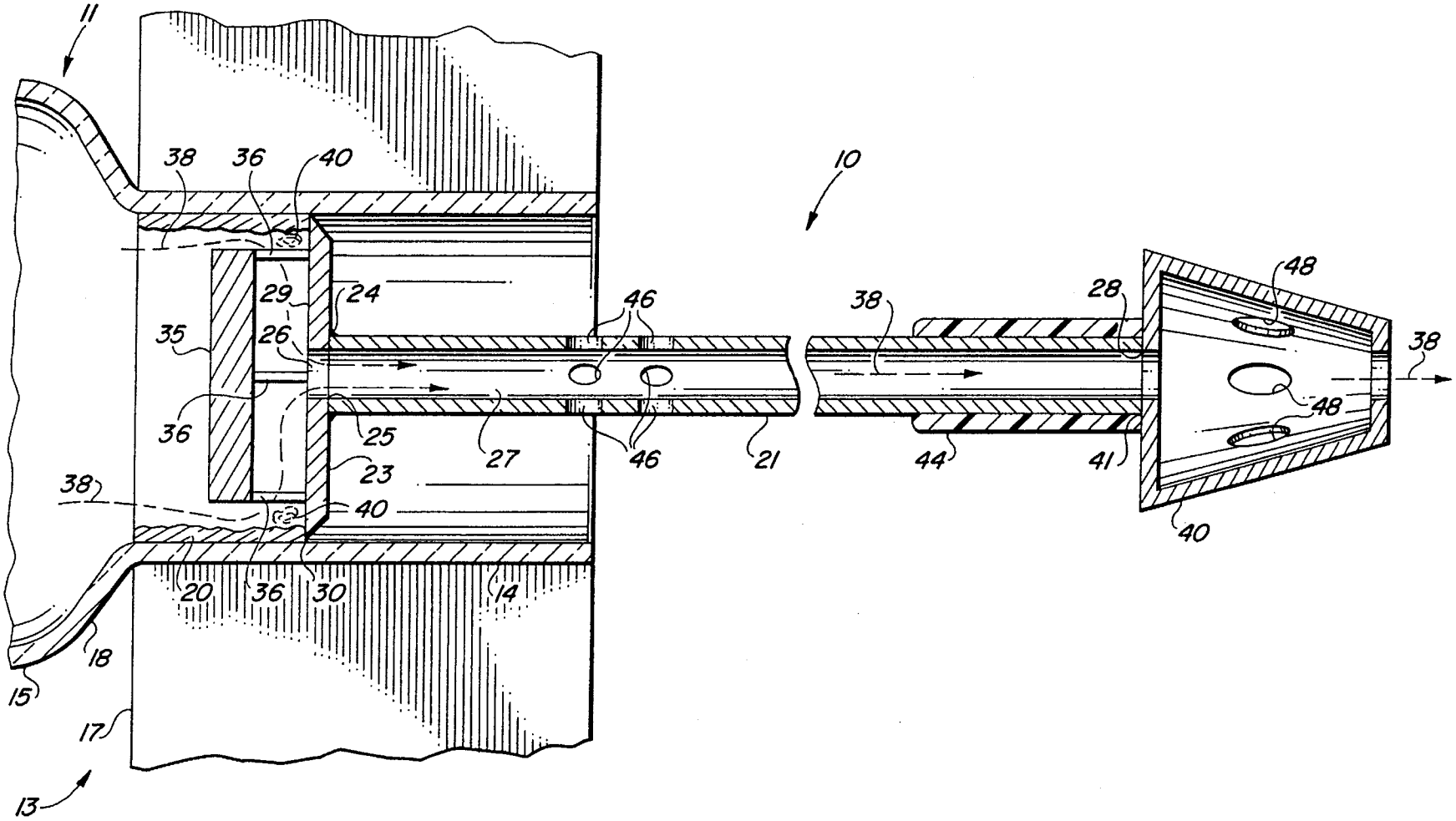
FIG. 1 is a side cross-sectional view of a scraper tool, according to a preferred embodiment of the invention. The tool is illustrated together with part of a tube of an lpcvd semiconductor processing apparatus in which it is being used.

A side cross-sectional view of a scraper tool 10, according to a preferred embodiment of the invention, is shown in FIG. 1. The tool 10 is shown inserted within part of a tube 11 of a typical lpcvd semiconductor processing apparatus. Although the scraper tool is described in conjunction with a typical use in cleaning a processing tube of an lpcvd apparatus, it should be understood that the tool may be used in other similar applications. As known, a typical lpcvd semiconductor processing apparatus 13 (only part of which being shown) contains a semiconductor processing tube 11.

The semiconductor processing tube 11 is located with an enlarged portion 15 inside the semiconductor processing apparatus 13. A neck portion 14 extends through a wall 17 of the semiconductor processing apparatus 13 that extends to an external location (not shown). The enlarged portion 15 of the tube 11 is generally of circular cross-sectional shape of sufficient diameter to enable semiconductor wafers, themselves of diameter of about five inches or more, to be carried inside upon a cantilevered beam inserted from an opposite end. The neck portion 14, however, is of smaller diameter, as shown, and the transition region 18 between the enlarged portion 15 and neck portion 14 is generally smooth, to facilitate smooth gas flow through the processing tube 11 during use.

At the external location, generally the neck portion 14 of the tube 11 is configured to enable a flange, or other structure, to be removably attached for connection to a vacuum line to evacuate the tube 11 and the interior of the lpcvd processing chamber. The tube 11 is generally of quartz, or similar material, to withstand semiconductor processing temperatures of 450 degrees C., or more.

According to a preferred embodiment of the invention, a scraper tool 10 is provided for cleanout of any debris 20 that may have formed within the neck portion 14 of the processing tube 11. The scraper tool 10 has an elongated pipe 21 that is of sufficient length to extend completely along the length of the neck portion 14 of the processing tube 11 when the tool 10 is inserted into the neck portion 14. A scraper plate 23 is attached, for example by welds 24 or other means to the end 25 of the pipe 21 located distally from the proximate operator handling end 28. The scraper plate has the same general shape as the interior of the neck portion of the tube 11, and usually will be generally circular. A hole 26 through the center of the scraper plate 23 provides a gas communication path from the front face 29 of the scraper plate 23 to the inside cavity or chamber 27 of the pipe 21. The peripheral edge of the scraper plate 23 may be beveled, as shown, to provide a scraping edge 30 to scrape and remove the debris 20 from the interior of the neck portion 14 of the tube 11.

As mentioned, the operation of the lpcvd semiconductor processing apparatus 13 involves the deposition of various materials in the processing of semiconductor wafers. At least in part due to the temperature differentials from inside to outside the apparatus, especially in nitride, silicon oxide, and silicon oxynitride deposition processes, debris 20 from the processes tend to deposit in the neck portion 14 of the tube 11. During cleanout of the debris 20, care must be taken to insure that flakes or particles removed from the neck portion 14 do not fall back within the enlarged portion 15, else they may source contaminates during subsequent semiconductor processing operations within the processing tube 11.

In addition to the scraper plate 23, the scraping end of the tool 10 has a baffle plate 35 connected to the scraper plate 23 by one or more standoffs 36. The baffle plate is of similar shape as that of the scraper plate 23, but is of smaller size to allow gas within the processing tube 11 to pass around its periphery to be drawn into the interior chamber 27 of the tube 21, as shown by the arrows 38. Thus, the debris flakes and particles 40 that are removed by the scraper edge 30 from the neck portion 14 are carried by the gas flow along the path of the lines 38 into the pipe 21 for immediate removal from the processing tube 11, with reduced risk of the flakes and particles 40 falling back into the enlarged portion 15 of the processing tube 11. Since the area of the baffle plate 35 is less than the area of the scraper plate 23, a venturi effect is created between the peripheral edge of the baffle plate 35 and the interior wall of the neck portion 24 to enhance pickup of the flakes and particles 40.

At the proximate operator handling end 28 of the pipe 21, a vacuum connector 40 may be provided for connection to a vacuum line (not shown). The vacuum connector 40 is a tapered cone to enable vacuum lines within a range of diameters, and is connected by welds 41 or other means to the proximate end 28 of the pipe 11.

Since, as mentioned, the processing temperatures may be extremely hot, and cleanout of the debris 20 may be performed while such high temperatures exist within the lpcvd apparatus 13, a heat insulating handle 44 may be provided at the proximate end 28 of the pipe 21. The heat insulating handle can be of any heat insulation material, such as a synthetic resin polymer. A suitable synthetic resin polymer may be, for example, the polymer identified by the trademark "Teflon."

Also, since the processing temperatures within the processing chamber may be extremely hot, one or more cooling holes 46 may be provided along the length of the pipe 21 to bring cooling atmosphere into the interior 27 of the tube 21. Such cooling may be necessary to prevent damage to the vacuum lines that may be attached to the vacuum connector 40. Although several holes 46 in the pipe 21, as shown, may be sufficient for cooling, if necessary, additional cooling holes 48 may be provided in the walls of the vacuum connector 40.

The various parts of the scraper tool 10, in particular the pipe 21, the scraper plate 23, the baffle plate 35 and standoffs 36, may be of any suitable material. For example, it has been found that stainless steel is suitable in many applications. In applications in which stainless steel may not be desirable, the entire tool 10 may be constructed of "Teflon," or similar material.

Although the invention has been described and illustrated with a certain degree of particularity, it will be understood that various changes in the combination and arrangement of parts may be resorted to by those skilled in the art, without departing from the sprit and scope of the invention as hereinafter claimed.

I claim:

1. A tool for cleaning the interior of a tube, comprising:

a pipe having an interior chamber for carrying a vacuum;

a scraper plate having a shape substantially conforming to an interior shape of the tube, attached to a distal end of said pipe, and having a peripheral edge, said scraper plate having an opening for communication with the interior chamber of said pipe;

a baffle plate of similar shape to, and smaller size than, said scraper plate;

at least one standoff positioned between said scraper plate and said baffle plate, said baffle plate providing a debris collection region between a peripheral edge of said baffle plate and an exterior side of said scraper plate when said tool is inserted into the tube; and a vacuum line connector attached proximate end; said vacuum line connector being provided with a plurality of holes therein to admit a cooling atmosphere into a vacuum line connected to said vacuum line connector, said vacuum line connector having a hole extending to an interior of said pipe for communicating a vacuum of the vacuum line to the interior chamber of said pipe.

2. The tool of claim 1 further comprising an insulating handle surrounding a proximate portion of said pipe.

3. The tool of claim 2 wherein said insulating handle is of synthetic resin polymers.

4. The tool of claim 3 wherein said pipe has a plurality of holes spaced from said insulating handle in a direction toward said distal end.

5. The tool of claim 1 wherein said scraper and baffle plates have a substantially circular shape.

6. The tool of claim 1 wherein said pipe, said scraper and baffle plates, and said at least one standoff are of stainless steel.

7. The tool of claim 1 wherein said pipe, said scrapper and baffle plates, and said plurality of standoffs are of synthetic resin polymers.

8. A tool for cleaning the interior of a tube, comprising:

a pipe having a proximate user end and a distal scraper end for insertion into a tube, said pipe having at least one hole formed along its length;

a scraper plate having a circumference and a shape substantially conforming to an interior shape of the tube, said scraper plate being coupled along an interior side to said distal scraper end of said pipe;

a baffle plate having a circumference less than that of said scraper plate;

at least one standoff extending between said scraper plate and said baffle plate, said baffle plate providing a debris collection region between a peripheral side of said baffle plate and the tube at the exterior side of said scraper plate when said tool is inserted into the tube; and a vacuum line connector attached to said proximate end, said vacuum line connector being provided with a plurality of cooling holes therein to admit a cooling atmosphere into the vacuum line when it is connected to said vacuum line connector, said vacuum line connector having a hole extending to an interior of said pipe for communicating a vacuum of the vacuum line to an interior chamber of said pipe.

9. The tool of claim 8 further comprising an insulating handle surrounding a portion of said pipe substantially adjacent to said proximate end.

10. The tool of claim 9 wherein said insulating handle is of synthetic resin polymers.

11. The tool of claim 9 wherein said at least one hole along the length of said pipe comprises a plurality of holes spaced from said insulating handle in a direction toward said distal end.

12. The tool of claim 8 wherein said scraper and baffle plates have a substantially circular shape.

13. The tool of claim 8 wherein said scraper plate has a beveled peripheral edge.

14. The tool of claim 13 wherein said beveled edge tapers in a direction towards said pipe.

15. The tool of claim 8 wherein said pipe, said scraper and baffle plates, and said plurality of standoffs are of stainless steel.

16. The tool of claim 8 wherein said pipe, said scraper and baffle plates, and said plurality of standoffs are of synthetic resin polymers.

17. The tool of claim 1 wherein said scraper plate is provided with a beveled peripheral edge.

* * * * *